US007002467B2

(12) United States Patent
Deconinck et al.

(10) Patent No.: US 7,002,467 B2
(45) Date of Patent: Feb. 21, 2006

(54) ALARM INTERFACE SYSTEM

(75) Inventors: Joseph Deconinck, West Babylon, NY (US); Dominick Dimonda, Seaford, NY (US)

(73) Assignee: Protex International Corporation, Bohemia, NY (US)

( * ) Notice: Subject to any disclaimer, the term of this patent is extended or adjusted under 35 U.S.C. 154(b) by 435 days.

(21) Appl. No.: 10/137,879

(22) Filed: May 2, 2002

(65) Prior Publication Data

US 2003/0206106 A1 Nov. 6, 2003

(51) Int. Cl.
*G08B 1/08* (2006.01)

(52) U.S. Cl. ..... 340/539.1; 340/539.25; 340/539.31; 340/568.2; 340/568.1; 340/571; 340/825.36; 340/825.49

(58) Field of Classification Search ..... 340/539.1, 340/539.16, 539.22, 539.25, 539.31, 568.1, 340/568.2, 571, 572.1, 572.8, 825.36, 825.49
See application file for complete search history.

(56) References Cited

U.S. PATENT DOCUMENTS

| | | | | |
|---|---|---|---|---|
| 3,444,547 | A | 5/1969 | Surek | |
| 3,665,448 | A | 5/1972 | McGlinchey et al. | |
| 4,540,977 | A | 9/1985 | Taillens et al. | |
| 4,746,909 | A | 5/1988 | Israel et al. | |
| 4,962,369 | A | * 10/1990 | Close | 340/572.1 |
| 5,543,782 | A | 8/1996 | Rothbaum et al. | |
| 5,561,417 | A | 10/1996 | Rothbaum et al. | |
| 5,726,627 | A | 3/1998 | Kane et al. | |
| 5,745,036 | A | 4/1998 | Clare | |
| 5,754,108 | A | 5/1998 | Ungarsohn | |
| 5,821,857 | A | 10/1998 | Rand | |
| 5,952,920 | A | 9/1999 | Braddick | |
| 5,990,938 | A | 11/1999 | Bern | |
| 5,995,004 | A | 11/1999 | Pellowski | |
| 6,075,443 | A | 6/2000 | Schepps et al. | |
| 6,104,289 | A | 8/2000 | Rand | |
| 6,198,391 | B1 | 3/2001 | DeVolpi | |
| 6,278,365 | B1 | 8/2001 | Kane et al. | |
| 6,429,893 | B1 | 8/2002 | Xin | |

* cited by examiner

*Primary Examiner*—Daryl Pope
(74) *Attorney, Agent, or Firm*—Collard & Roe, P.C.

(57) ABSTRACT

An alarm interface for a merchandise security system is coupled to an alarm system of the merchandise security system. The alarm interface includes one or more wireless interface transmitters and receivers. One or more output devices are connected to at least one of the one or more wireless receivers. In one aspect, the alarm system includes a controller for sensing alarm events, one or more hubs connected to the controllers, and a plurality of sensors capable of attachment to a plurality of objects to be secured. A set of sensors within the plurality of sensors is attached to a corresponding hub, and each sensor or hub generates an alarm event when separated from the controller or object to be secured. The wireless interface transmitters wirelessly transmit one or more alarm signals from the alarm system. The wireless interface receivers are adapted to receive at least one of these alarm signals transmitted from one or more of the wireless interface transmitters. One or more of the output devices are activated by at least one of the wireless interface receivers in response to at least one alarm signal-received by the receiver.

21 Claims, 14 Drawing Sheets

ALARM INTERFACE SYSTEM

BACKGROUND OF THE INVENTION

1. Field of the Invention

The present invention relates to security and anti-theft devices. More particularly, it relates to an alarm interface system between an alarm system and a video camera or other output device to protect merchandise and consumer product displays.

2. The Prior Art

At the present time, there are a large variety of anti-theft security systems commonly used in many retail establishments, especially those that sell expensive and easily portable items such as consumer electronics. See, e.g., the security systems described in U.S. Pat. Nos. 5,543,782 and 5,561,417 to Rothbaum et al., U.S. Pat. Nos. 5,726,627 and 6,278,365 to Kane et al., and U.S. Pat. Nos. 5,821,857 and 6,104,289 to Rand. In many of these devices the anti-theft security system has a command module or controller and a plurality of sensor satellites or hubs arranged in a daisy chain configuration. The command module and sensor satellites operate with microprocessors to monitor sensors attached to items to be secured and to the satellites. Cutting the wire attaching the sensor to the satellite or the satellite to the command module, or removing the sensor from the item, generates an alarm event which is detected by the central command module and causes an alarm to sound. In other devices, the alarm and detection circuitry and all connections to the sensors are located in one housing without requiring separate alarm modules or splitter boxes. Item cords connect the sensors directly to an alarm circuit. In still other devices, a cable has mating connectors which form a closed loop after being intertwined with an item to be protected. Both ends of the cable extend from an alarm box which sounds an alarm if the cable is disconnected. See, e.g. U.S. Pat. No. 3,444,547.

Although these systems have many benefits, there is still a need to improve on such systems by providing an interface between the alarm system and a video camera or other output device so that the output device or devices can be readily activated when the alarm system generates an alarm event.

SUMMARY OF THE INVENTION

An alarm interface system for a merchandise security system is provided. The merchandise security system includes an alarm system to which the alarm interface is coupled, and one or more output devices are connected to the alarm interface. In one aspect, the alarm system includes a controller for sensing alarm events generated by the alarm system, one or more hubs connected to the controller, and a plurality of sensors capable of attachment to a plurality of objects to be secured. Each hub has attached to it a set of sensors within the plurality of sensors. Each sensor or hub generates an alarm event when separated from the controller or object to be secured.

In another aspect, the alarm system includes a controller for sensing alarm events generated by the alarm system and a plurality of sensors capable of attachment to the controller and a plurality of objects to be secured. Each sensor generates an alarm event when separated from the controller or object to be secured.

The alarm interface includes one or more wireless interface transmitters and one or more wireless interface receivers. The wireless interface transmitters transmit one or more alarm signals. The alarm signals may contain information corresponding to a location of the sensor or, if hubs are in the system, the hub generating an alarm event. Other signals transmitted may include a signal indicating that the alarm system is armed or disarmed. Another signal transmitted may be a signal indicating a low battery in the alarm system. The wireless interface receivers are adapted to receive at least one or more alarm signals transmitted when the at least one alarm signal contains selected information.

At least one output device is activated by a wireless interface receiver in response to the alarm signal received by the wireless interface receiver.

BRIEF DESCRIPTION OF THE DRAWINGS

Other objects and features of the present invention will become apparent from the following detailed description considered in conjunction with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1A:
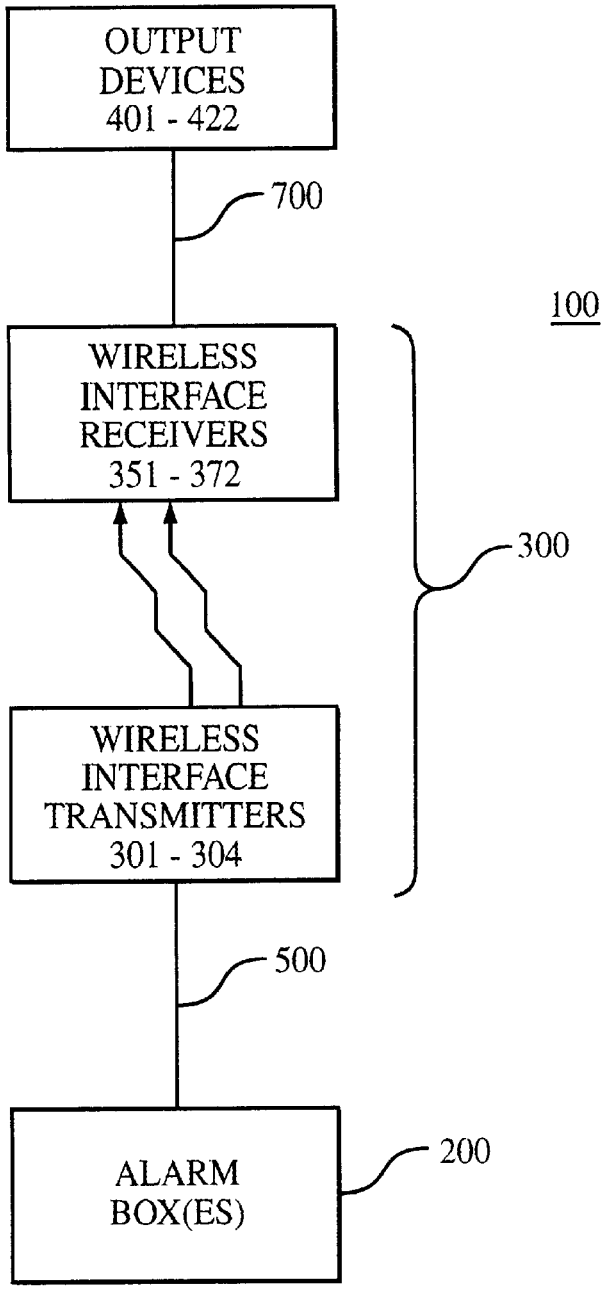
FIG. 1A is a schematic block diagram showing the overall parts of an embodiment of the present invention.

Turning now in detail to the drawings, FIG. 1A shows a merchandise security system 100 including one or more alarm systems 200, an alarm interface 300, and one or more output devices 401–422. Alarm interface 300 is addressable or can be programmed to permit specific receivers within the interface to respond. Alarm interface 300 includes at least one wireless interface transmitter, such as transmitters 301–304, and at least one wireless interface receiver, such as receivers 351–372. The transmitters are connected to respective alarm boxes 200, preferably by cables 500. The receivers are likewise connected to the respective output devices, preferably by cables 700.

Figure 2A:
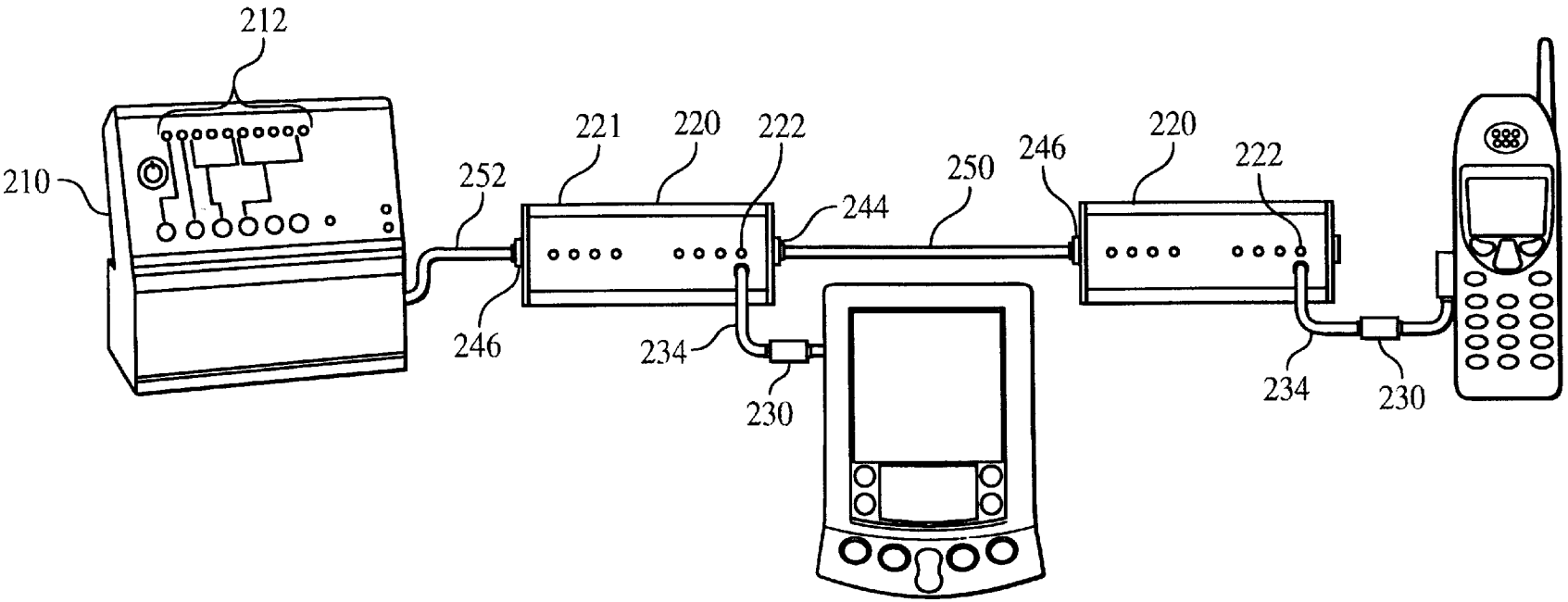
FIG. 2A is a diagram of an alarm system in accordance with one aspect of the invention.
Figure 2B:
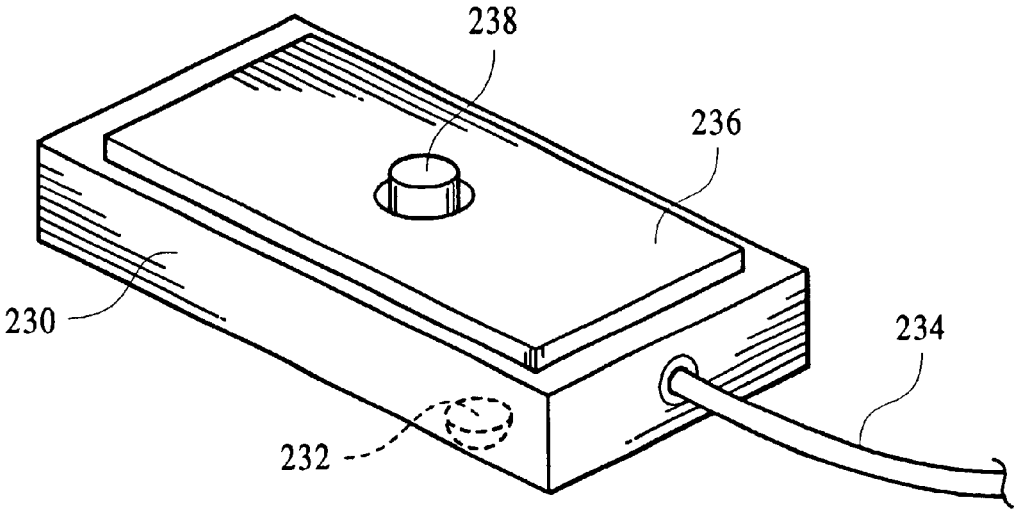
FIG. 2B is a perspective view of one form of sensor used with the alarm system of FIG. 2A.
Figure 2C:
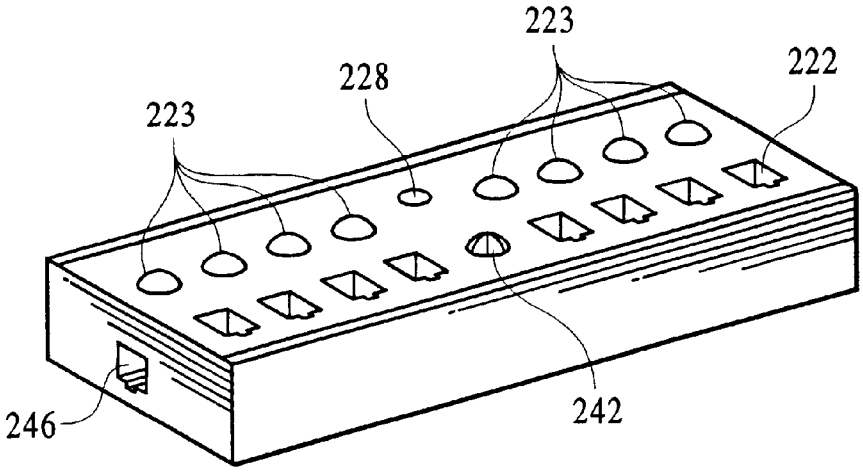
FIG. 2C is a perspective view of one form of hub used with the alarm system of FIG. 2A.

Each alarm system 200 may be an alarm system such as is described in U.S. Pat. Nos. 5,726,627 or 6,104,289. As shown in FIG. 2A, alarm system 200 includes a control unit 210, a plurality of hubs 220 and a plurality of sensors 230 coupled to the hubs 220. As shown in FIG. 2B, each sensor 230 may include an indicator 232 such as an LED and a sensor cable 234. Sensor 230 is connected to an object, for example, by adhesive foam tape 236 which depresses plunger 238 and closes a switch (not shown) contained within sensor 230 to complete the circuit as described in U.S. Pat. No. 6,104,289. The sensor 230 is connected to a hub 220 by plugging the sensor cable 234 into a sensor jack 222 having corresponding status indicators 223 such as bi-color LEDs having red and green operating modes as shown in FIG. 2C. Each hub 220 includes a plurality of sensor jacks 222. Each hub 220 also includes a hub/sensor location annunciator 242, a hub reset switch 228, and an upstream jack 246 and a downstream jack 244. The downstream jack 244 is connected to another hub 220 by using hub connection cable 250. The hub connection cable 250 is connected between the downstream jack 244 of one hub 220 and the upstream jack 246 of another hub 220. In this manner, a plurality of hubs 220 can be connected in a serial chain. The first hub 221 is connected to the control unit 210 by a control unit hub connection cable 252 connected to the upstream jack 246 of the first hub 221 and the control unit 210.

The control unit 210 includes the display unit including indicator lights 212 and optionally a keypad (not shown). Information such as passwords and commands may be entered through the keypad 214 and displayed on control unit 210. The control unit 210 also displays other data such as alarm event locations using the display unit 212.

Each hub 220 is connected with either the control unit 210 or a hub 220 through the upstream jack 246 and/or a hub 220 through the downstream jack 244. The last hub 222 is connected only to one other hub 220 through the upstream jack 246. Hubs 221 and 222 are identical to each other and to any other hubs 220 used in the system except that hub 221 is connected to the control unit 210 and the hub 222 is the last hub in the chain of hubs. Accordingly, all reference to hubs 220 also apply to the hubs 221 and 223.

As is more fully described in U.S. Pat. Nos. 5,726,627 or 6,104,289, the controller or control unit 210 senses alarm events generated by each sensor 230 or hub 220 when the sensor or hub is separated from the controller or object to be secured, such as an item of merchandise.

Figure 3A:
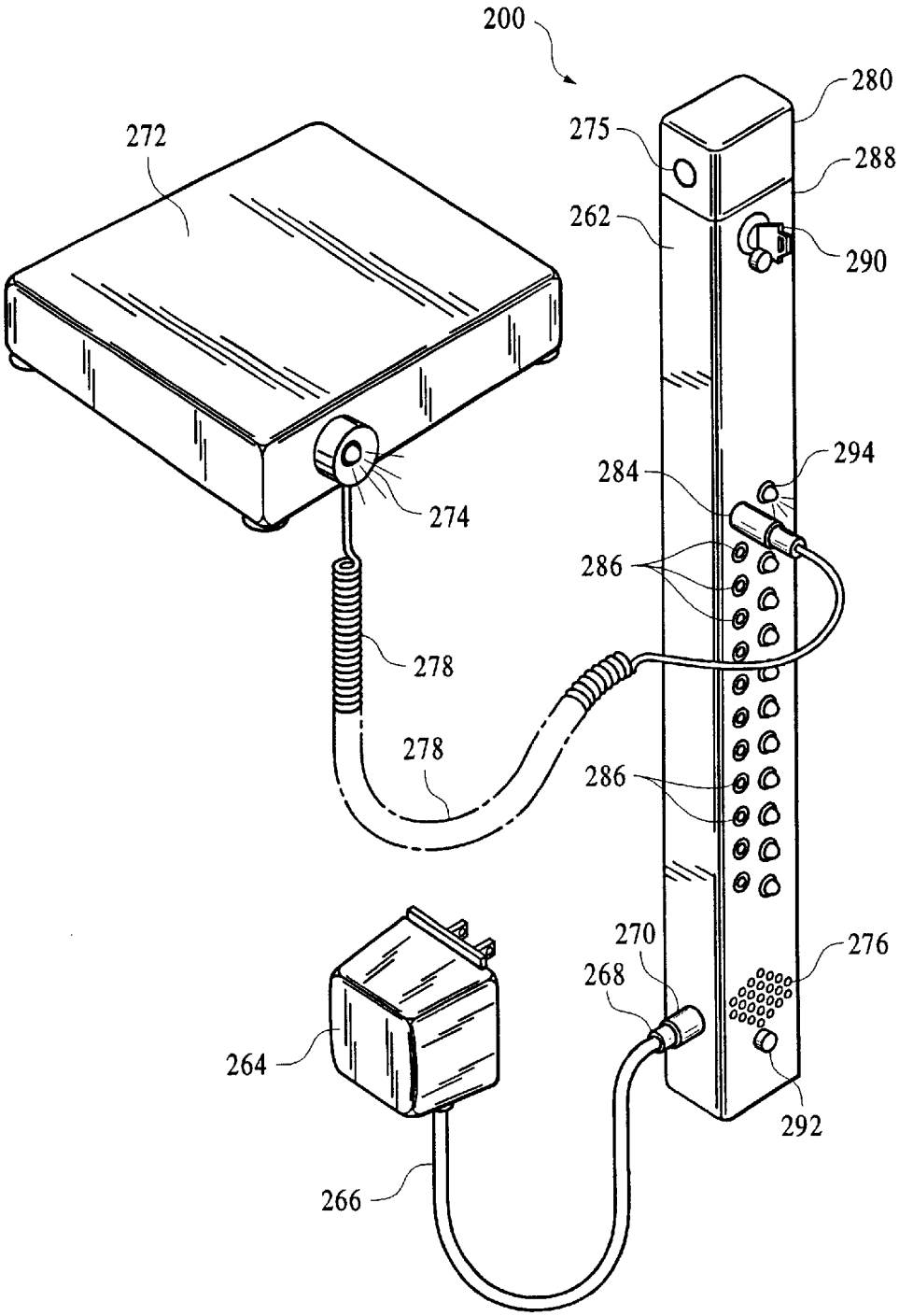
FIG. 3A is a diagram of another form of alarm system in accordance with a further aspect of the invention.

Alternatively, alarm system 200 may be an alarm system such as is described in U.S. Pat. No. 5,543,782. As shown in FIG. 3A, a multi jack alarm system 200 includes a strip or housing 262 containing the majority of the circuitry for the system. Twelve jacks are shown but alarm system 200 may have other numbers of jacks. For example sixteen jacks could be included. Power to the alarm system 200 is supplied by an AC adapter 264. AC voltage is converted by AC adapter 264 to a low voltage DC, such as nine or ten volts, and is supplied to the system circuitry via power cord 266.

Power cord 266 may be hard-wired to the security system. However, for flexibility and maintenance reasons, a two-wire plug 268 is attached to the end of the power cord 266 for connection to the alarm circuit. A jack 270 on the housing 262 plug 268. The wires connected to jack 270 carry the voltage to the circuitry.

Whenever plug 268 is inserted into jack 270 and adapter 264 is being supplied AC power from an outlet, power indicator light 292 is lit. If power is interrupted (e.g., plug 268 is removed from jack 270 or there is an AC power failure) power LED 292 is turned off. The illumination of power indicator 292 is independent of the position of key switch 288 which switches the alarm system from a SET-UP mode to the armed or ON mode by turning key 290.

In the embodiment shown in FIG. 3A, a number of items of merchandise 272 may be secured by attaching sensors, such as hard goods sensor 274, to the merchandise. For example, twelve, sixteen or some other number of items may be secured depending on the particular design. Hard goods sensor 274 is connected to the alarm circuitry in strip 262 by item cord 278.

A dual-switch mating jack 286 is mounted in the housing 262. The sensor plug 284 at the end of item cord 278 and its corresponding mating jack 286 are off-the-shelf items. When a sensor is attached to an article, current flows from the alarm circuit through plug 284 to the sensor and back to the alarm circuit and LED 294 on strip 262 for that plug is turned on.

A horn 276 is provided in strip 262 which sounds once a breach of security condition is detected. In addition, strip 262 may be provided with a battery inside a compartment 280 secured by battery compartment screw 275.

Figure 3B:
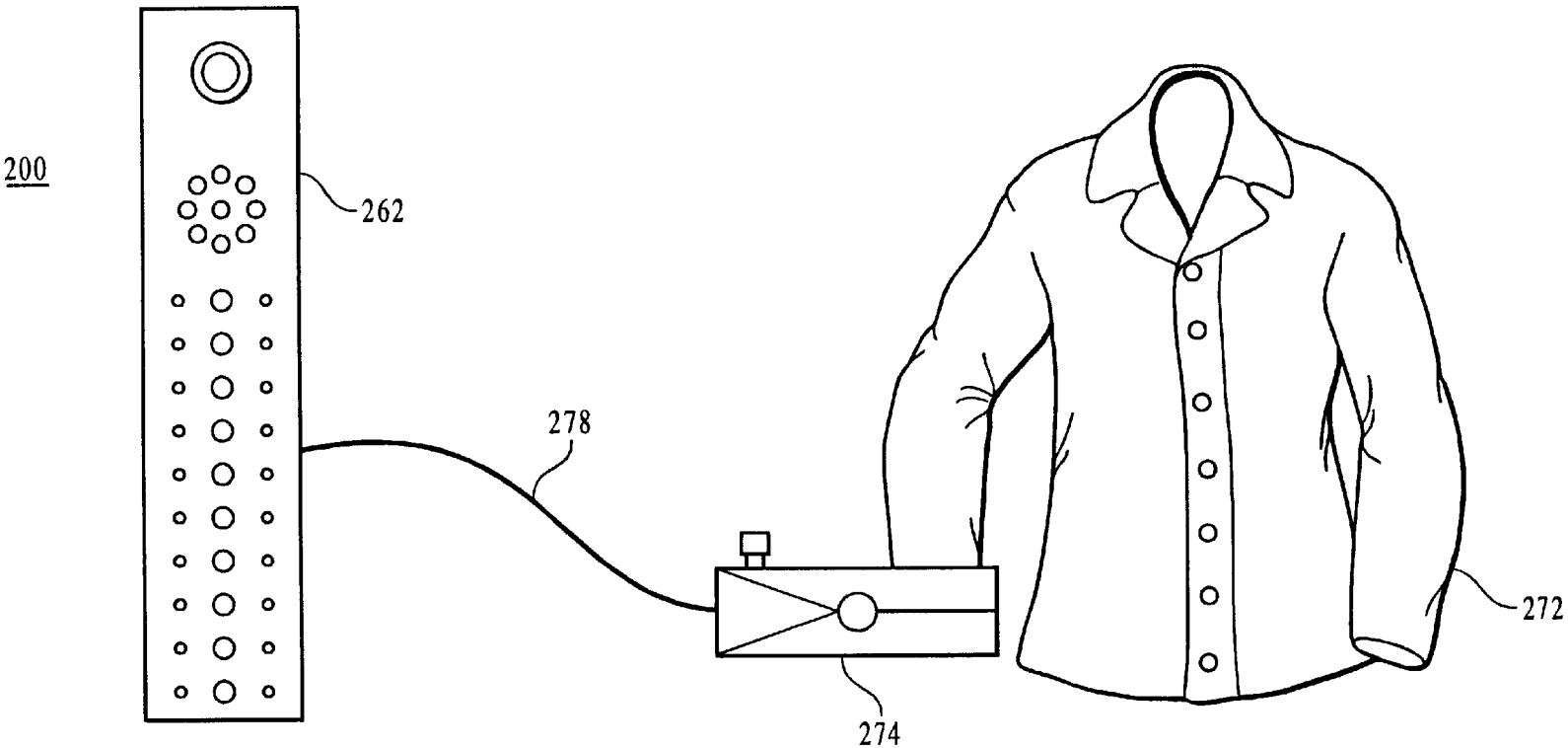
FIG. 3B is a diagram of another form of alarm system in accordance with a further aspect of the invention.

FIG. 3B shows another form of alarm system known as the Electronic ProAlert (EPA) available from Protex International Corp., Bohemia, N.Y. As shown in FIG. 3B, alarm system 200 includes an alarm box 262 containing the majority of the circuitry for the system. A number of items of merchandise, such as garment 272, may be secured by attaching a soft goods sensor or clip 274 to the garment. Clip 274 is connected to the alarm circuitry in alarm box 262 by cable 278.

Another form of alarm system is known as the Loop Alarm also available from Protex International Corp., Bohemia, N.Y. In this alarm system, a cable loops around an item of merchandise and connects to itself to complete the circuit.

Other forms of alarm systems may also be used, such as the alarm system shown in U.S. Pat. No. 5,561,417. In addition, standard fire alarm or motion detector or other stand-alone alarm device may be used as the alarm system.

The alarm interface 300 coupled to alarm system 200 includes one or more wireless interface transmitters 301–304 and one or more wireless interface receivers 351–372.

Figure 1B:
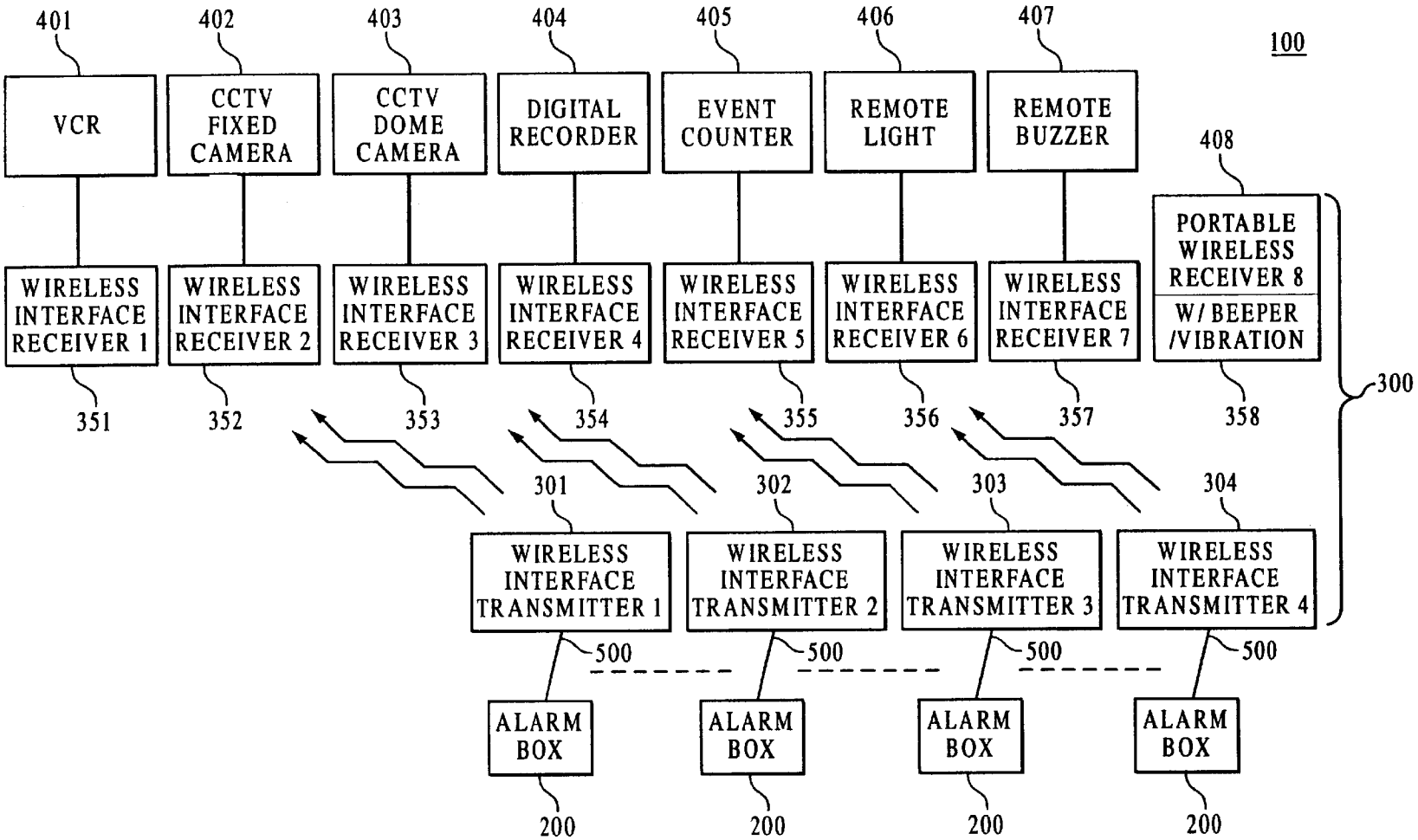
FIG. 1B is a schematic block diagram showing a number of output devices that can be used in the embodiment of FIG. 1A.

As shown in FIG. 1B, each wireless interface transmitter 301–304 is connected to an alarm system 200. For example, wireless interface transmitter 301 may be connected to the command module 210 of the alarm system of FIG. 2 or the alarm box 262 of the alarm system of FIGS. 3A–3B. The wireless interface transmitter is preferably connected to the command module or the alarm box using, for example, a 12-foot, 6-conductor modular cable 500 with 6-position, 6-contact modular jacks at each end. Other types of connections may be used. The alarm output of alarm system 200 can be hard-wired to an external annunciator, such as external lights, through the same connector 500 used for alarm interface 300. The alarm output preferably has three pulse rates or duration sequences to identify alarm, arm/disarm and low battery conditions. The wireless interface transmitter preferably communicates with a corresponding wireless interface receiver over a suitable distance, preferably to 300 feet, with a minimum distance with limited obstacles of, for example, fifty feet. Preferably four transmitters 301–304 and as many as eight transmitters are connected to a given receiver 351. In other words, each receiver 351–372 preferably has the capacity to receive signals from each of the four or eight transmitters. However, any of the receivers could be adapted so as to receive signals from a greater number of transmitters, for example, more than eight.

An infinite number of receivers can be connected to the same transmitter. Preferably, an unlimited number of receivers can communicate with a given transmitter. Preferably, each receiver has the ability to "learn" and "unlearn" transmitters, i.e. to be adapted to accept or not accept signals from selected transmitters. Alternatively, each receiver has the ability to be matched to a selected receiver using dip switches. The wireless interface receivers can be connected to a variety of different output devices 401–422. All possible devices may or may not be included in a given system.

At least one output device 401–422 is connected to at least one wireless interface receiver 351–372 by one or more cables and may be activated when its corresponding wireless interface transmitter is separated from the controller or alarm box or the wireless interface receiver or receivers is separated from the output device. For example, the cable connection to the output device may form a normally closed circuit which triggers the output device when the circuit becomes open such as when the cable is cut. Conversely, the cable connection could form a normally open circuit which would be triggered when the circuit is closed. For this circuit, severance of the cable connection could form a closed circuit, thereby triggering the output device.

Examples of the various output devices are shown in FIGS. 1B to 1E. For example, as shown in FIG. 1B, wireless interface receiver 351 may be connected to the input of a recording device such as a video cassette recorder (VCR) 401. When wireless interface transmitter 301 sends a signal to receiver 351, the receiver closes a relay connected to the VCR input, which triggers VCR 401 to start recording at the start of the alarm condition.

Similarly, wireless interface receiver 352 may be connected to the input of a fixed video camera such as a closed circuit television (CCTV) camera. When transmitter 301 sends a signal to receiver 352, receiver 352 closes a relay connected to the CCTV fixed camera input, which triggers the camera to start recording at the start of the alarm condition. If this camera 402 is connected to a digital or other recorder, saved recordings prior to the alarm event can be captured.

Wireless interface receiver 353 is shown in FIG. 1B connected to the input of a CCTV dome camera 403. When transmitter 302 sends a signal to receiver 353, receiver 353 closes a relay connected to the CCTV dome camera input, which triggers the camera 403 to swing over to a preprogrammed location and start recording at the start of the alarm condition.

Wireless interface receiver 354 is connected to the input of a digital recorder 404. When transmitter 302 sends a signal to receiver 354, receiver 354 closes a relay connected to the digital recorder input, which triggers the digital recorder 404 to start recording at the start of the alarm condition. If the camera is fixed, the system can capture events occurring before the alarm condition.

Wireless interface receiver 355 is connected to the input of an event counter 405. When transmitter 303 sends a signal to receiver 355, receiver 355 closes a relay connected to the event counter input which triggers the event counter 405 to put a time stamp on the event at the start and stop of the alarm condition. In addition to a signal containing information that an alarm condition has occurred at the alarm system, wireless interface transmitter 303 may be designed to transmit signals indicating a low battery condition or a condition indicating that the system is in either the armed or the disarmed state. Thus, event counter 405 will be able to see how many times the alarm unit was armed and disarmed or when a low battery condition occurred and what unit it was that had the condition.

The information generated by the event counter may be used to monitor human traffic or demographics for marketing purposes. For example, the arming/disarming information could be used to monitor sales volume as the system is typically disarmed when a sale is being transacted.

Wireless interface receiver 356 is connected to a remote light 406. When transmitter 303 sends a signal to receiver 356, receiver 356 closes a relay connected to remote light 406, which triggers the remote light to turn on at the start of the alarm condition. Light 406 could be located anywhere in the store for convenience.

Similarly wireless interface receiver 357 is connected to a remote buzzer 407 which can be located anywhere in the store and be turned on at the start of the alarm condition when receiver 357 closes a relay in response to a signal transmitted by wireless transmitter 304.

Wireless interface receiver 358 can also be made portable with the output device 408 incorporated in receiver 358. When transmitter 358 sends a signal to portable receiver 358, receiver 358 will act similar to a pager by either beeping or vibrating to tell someone that an alarm condition has occurred. Receiver 358 may also be designed to determine whether there was an alarm condition at the controller of the alarm system and to trace the alarm condition down to the particular satellite or sensor causing the condition. Receiver 358 may also be designed to determine whether the battery was low, or whether the unit was armed or disarmed.

Figure 1C:
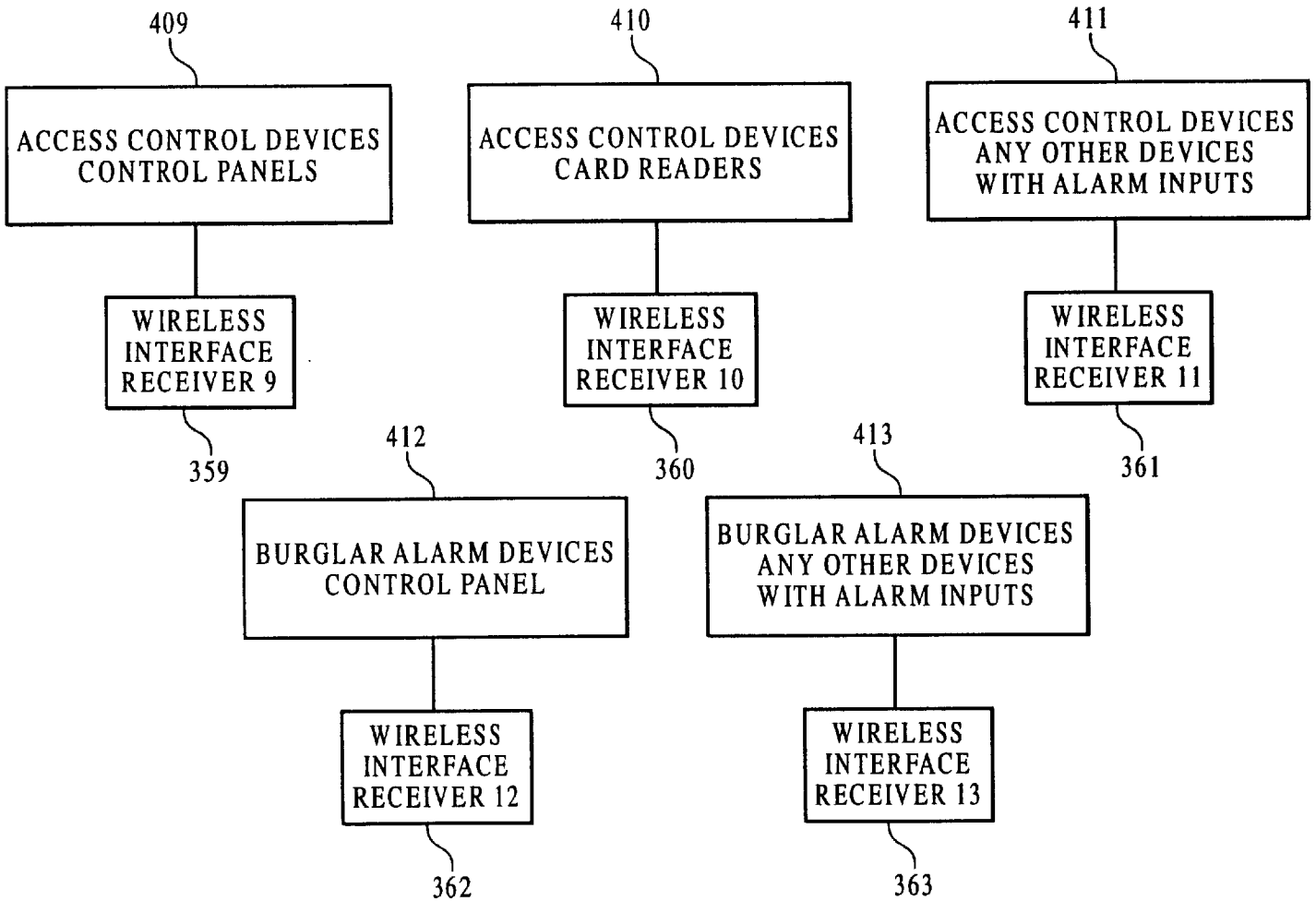
FIGS. 1C to 1E are schematic block diagrams showing further output devices that can be used in the embodiment of FIG. 1A.

As shown in FIG. 1C, wireless interface receiver 359 is connected to the input of an access control panel 409. When transmitter 301 sends a signal to receiver 359, receiver 359 closes a relay connected to the access control panel input.

Similarly, wireless interface receivers 360 and 361 can be connected to the respective input of an access control card recorder 410 or other access control device 411 with alarm input. When transmitter 301 sends a signal, the receiver closes a relay connected to the input of the device.

Likewise, wireless interface receivers 362 and 363 can be connected to the respective input of a burglar alarm control panel 412 or any burglar alarm device 413 with alarm input. Receiver 362 and 363 closes a respective associated relay connected to the input of the device in response to a signal from the transmitter.

Figure 1D:
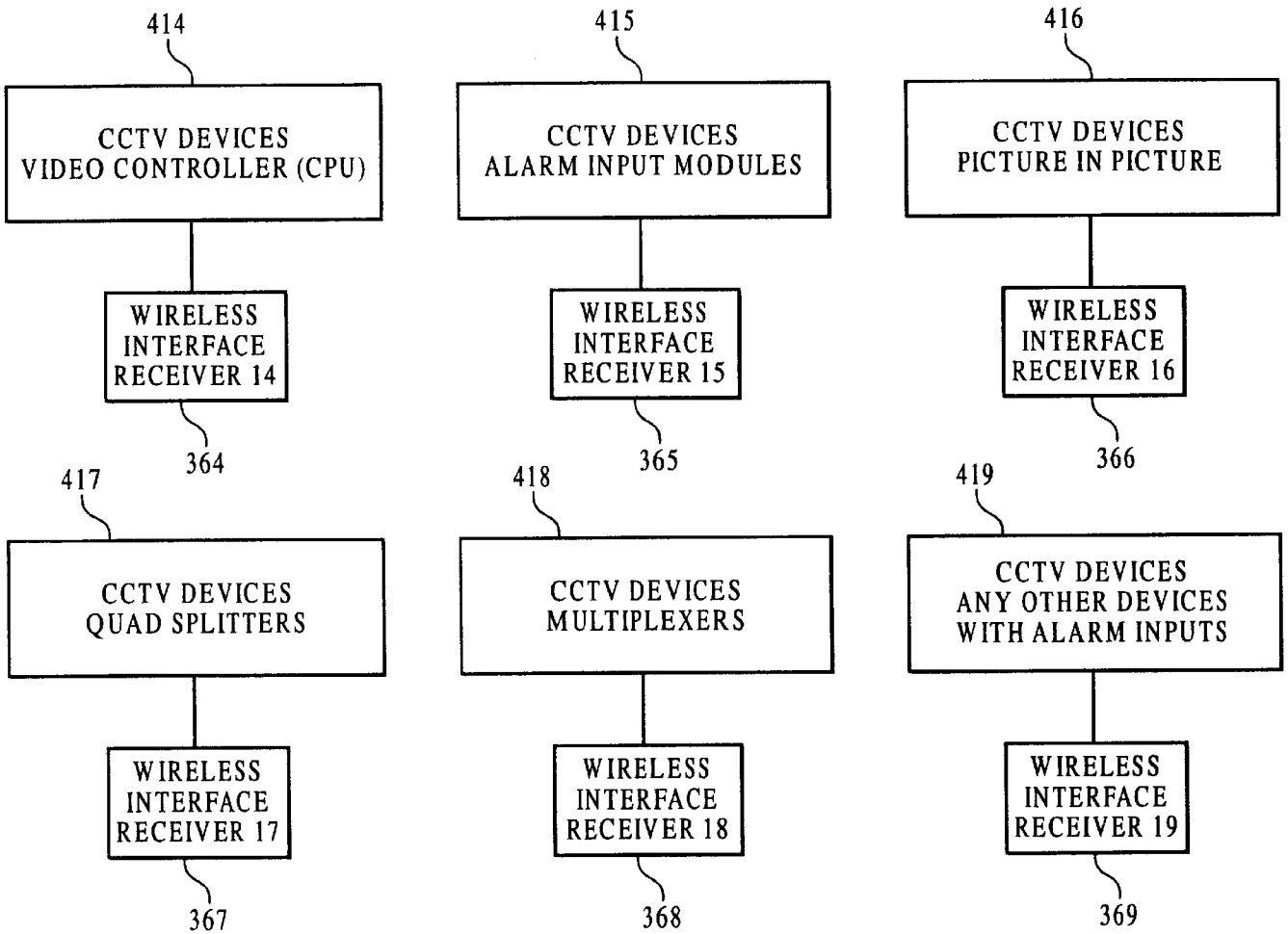

As shown in FIG. 1D, other devices include a CCTV video controller (CPU) 414, a CCTV alarm input module 415, a CCTV picture in picture 416, a CCTV Quad splitter 417, a CCTV multiplexer 418, or any CCTV device 419 with alarm input. Receivers 364–369 are respectively connected to the inputs of these devices and close a relay connected to the inputs in response to a signal from a transmitter.

Figure 1E:
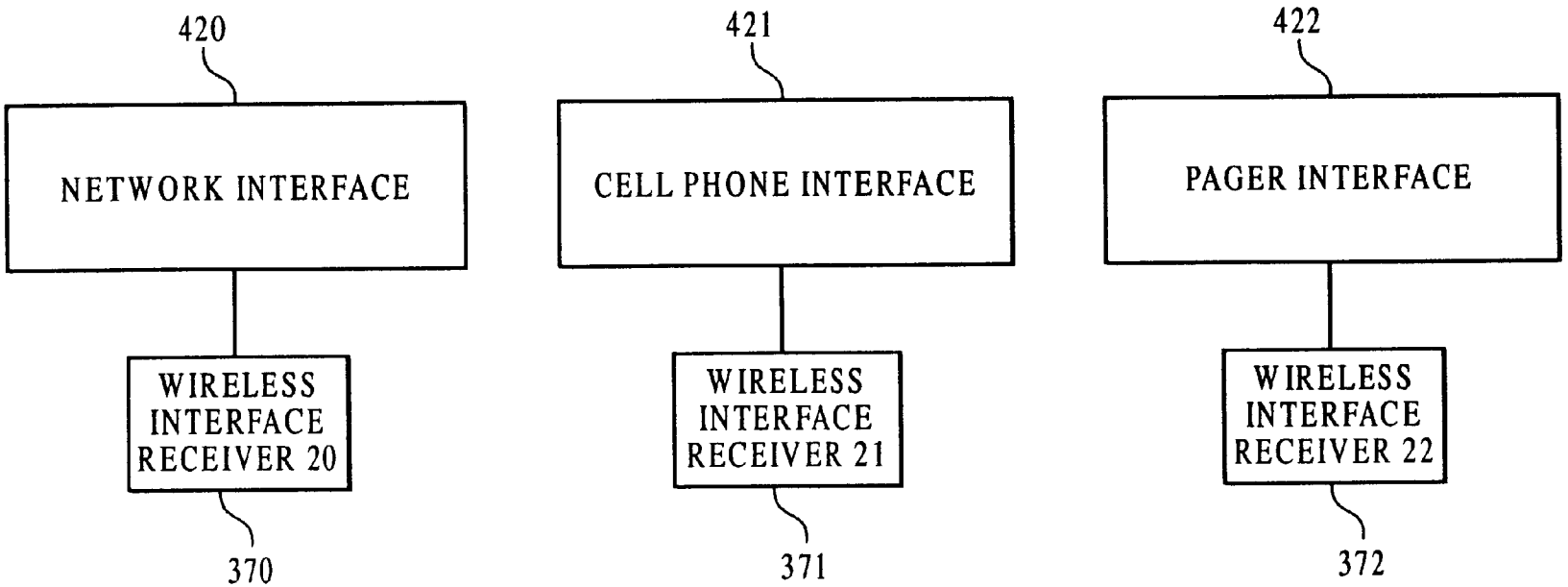

As shown in FIG. 1E, wireless interface receivers 370–372 can be connected to the input of any network interface device 420, cell phone interface device 421, or pager device 422 that accepts inputs. When the transmitter sends a signal to the receiver, the receiver closes a relay connected to the input of the device. For a cell phone interface device 421 or pager device 422, the device would then dial a cell phone or pager.

Figure 4:
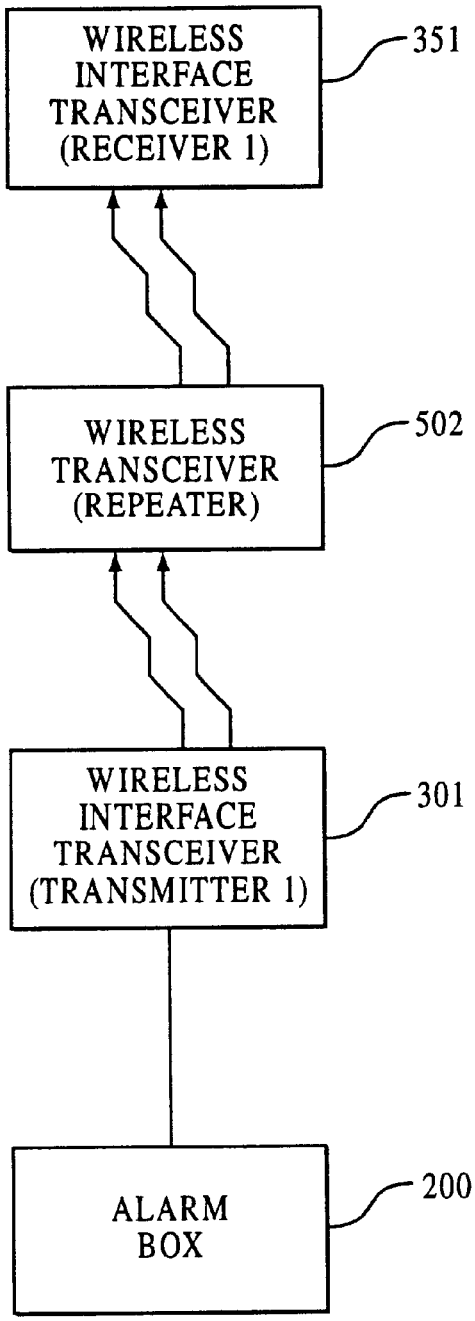
FIG. 4 is a schematic block diagram showing the use of a wireless repeater in accordance with a further embodiment of the invention.

Each of the transmitters and receivers may be transceiver units to provide feed back to one another as to whether the radio frequency signal was transmitted or received. Preferably, the radio frequency range between transceivers or transmitter and receiver is at least 200 feet in an open field and at least 50 feet in a store environment with obstructions. As shown in FIG. 4, if longer distances between transceivers or transmitters and receivers are required, one or more wireless repeaters 502 which may also be transceivers may be provided to increase the length between transceivers or transmitter and receiver.

The RF frequency may be a 433 MHz to 800 MHz scan spectrum so that frequency is automatically adjusted to adapt to environmental noise conditions. However, it is not necessary to use a scan spectrum and other frequencies may also be used besides those in the range 433 MHz to 800 MHz.

Figure 5:
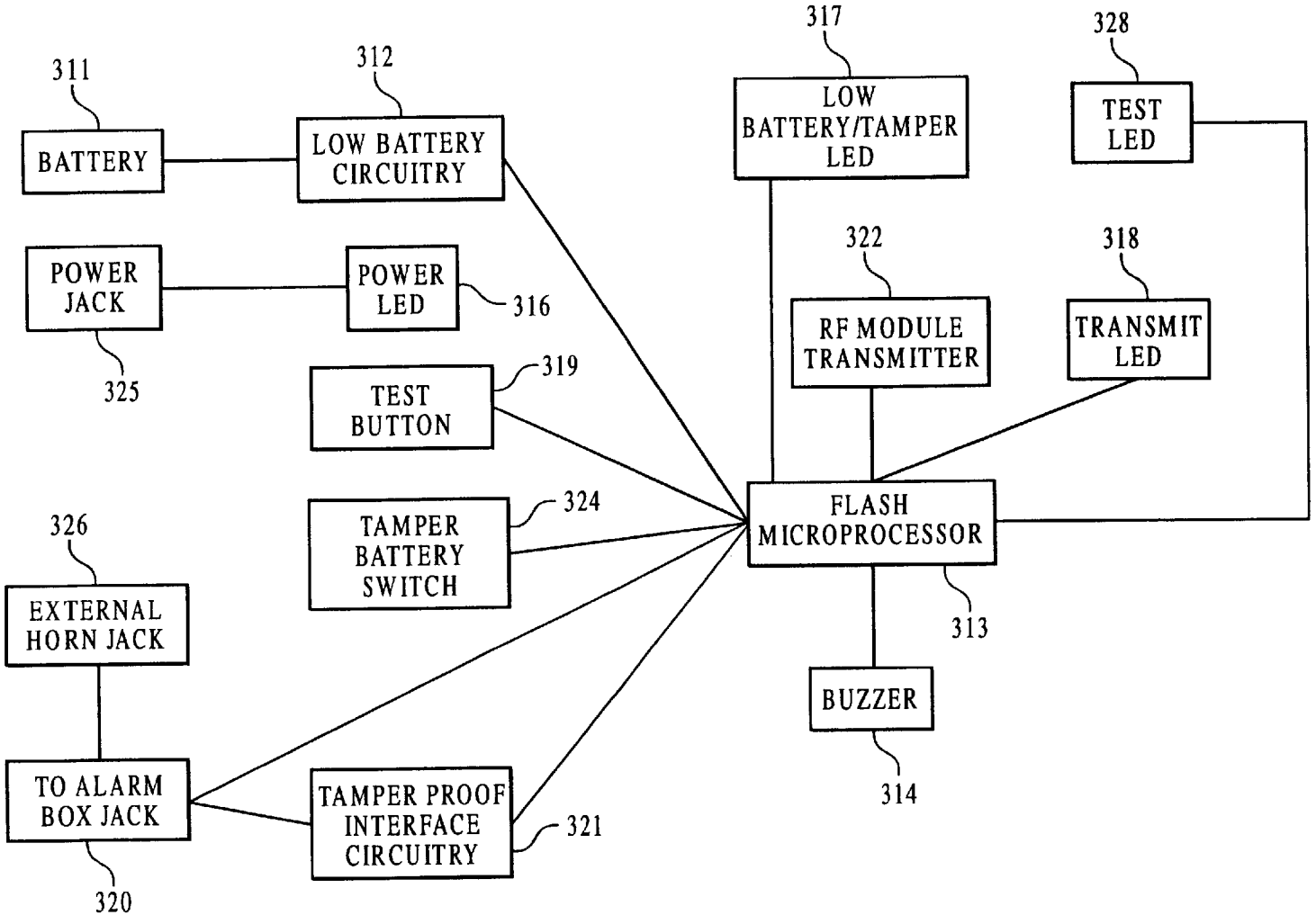
FIG. 5 is a schematic block diagram of a wireless interface transmitter incorporated in the embodiment of FIG. 1.
Figure 6:
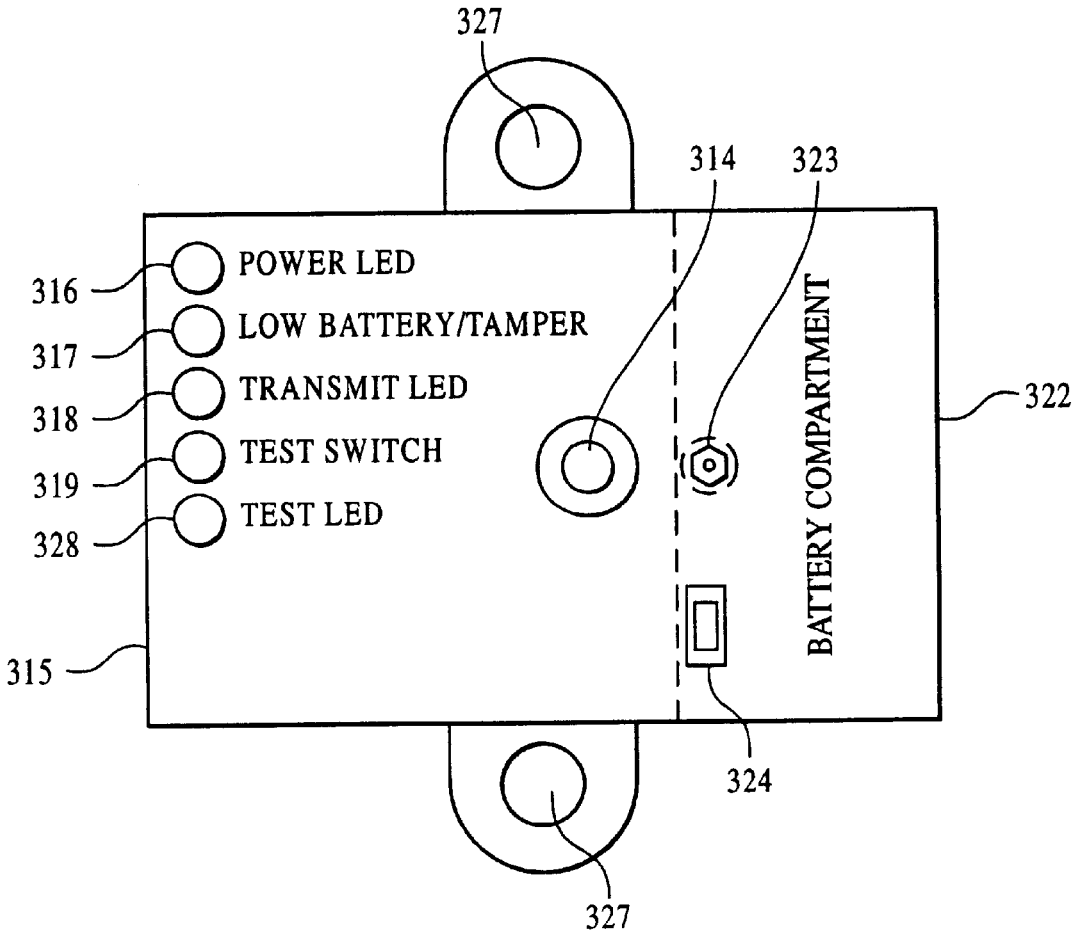
FIGS. 6 and 7 are top and side views respectively of the wireless interface transmitter of FIG. 5.
Figure 7:
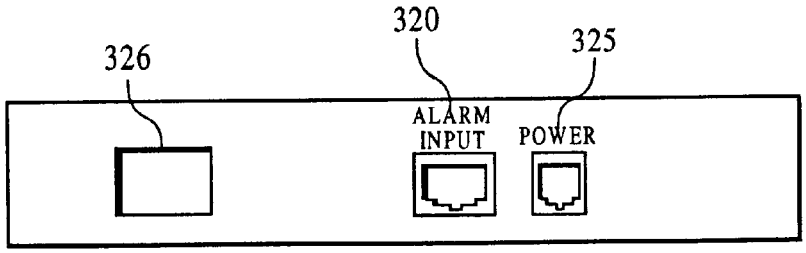
Figure 8:
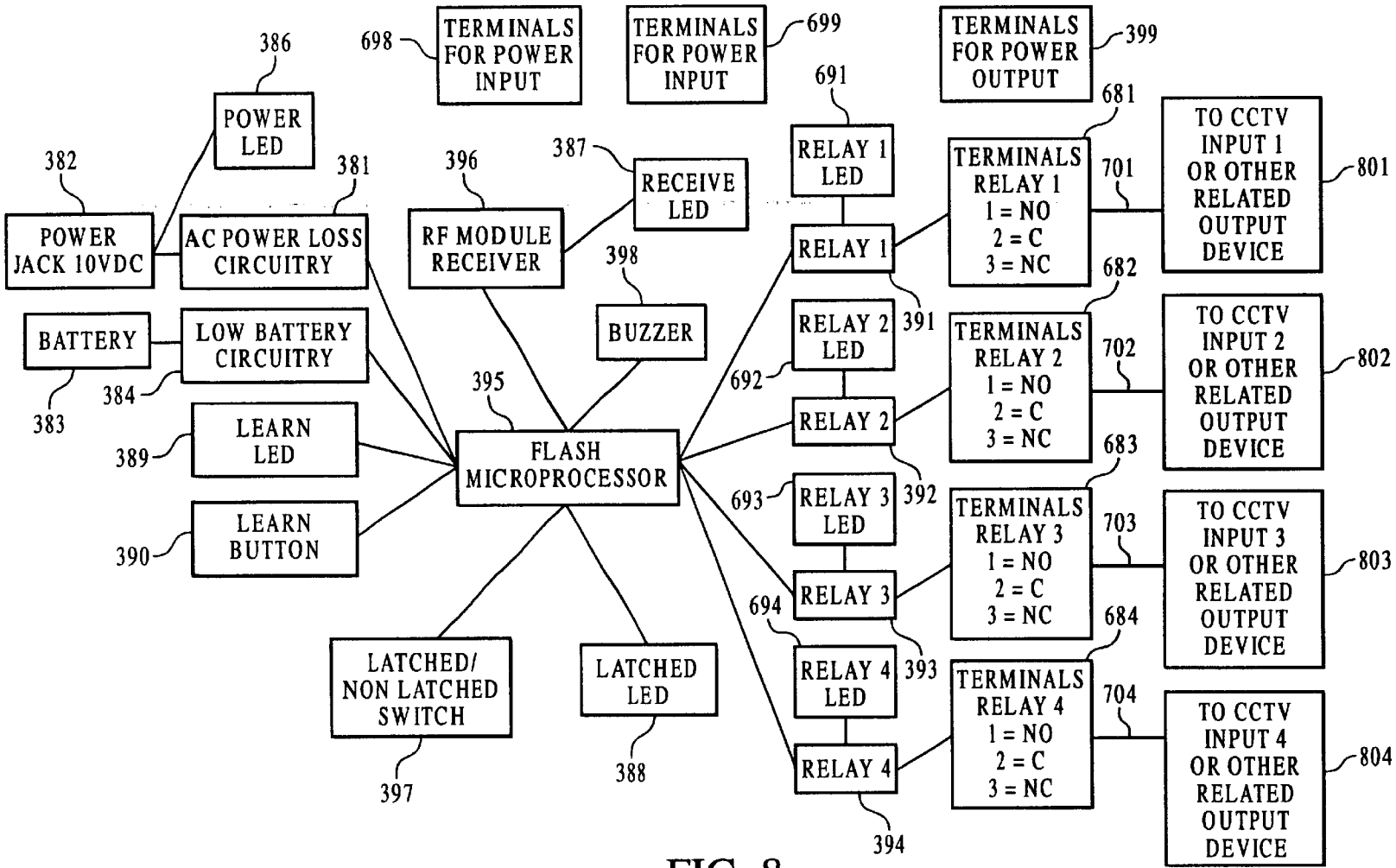
FIG. 8 is a schematic block diagram of a wireless interface receiver incorporated in the embodiment of FIG. 1.
Figure 9:
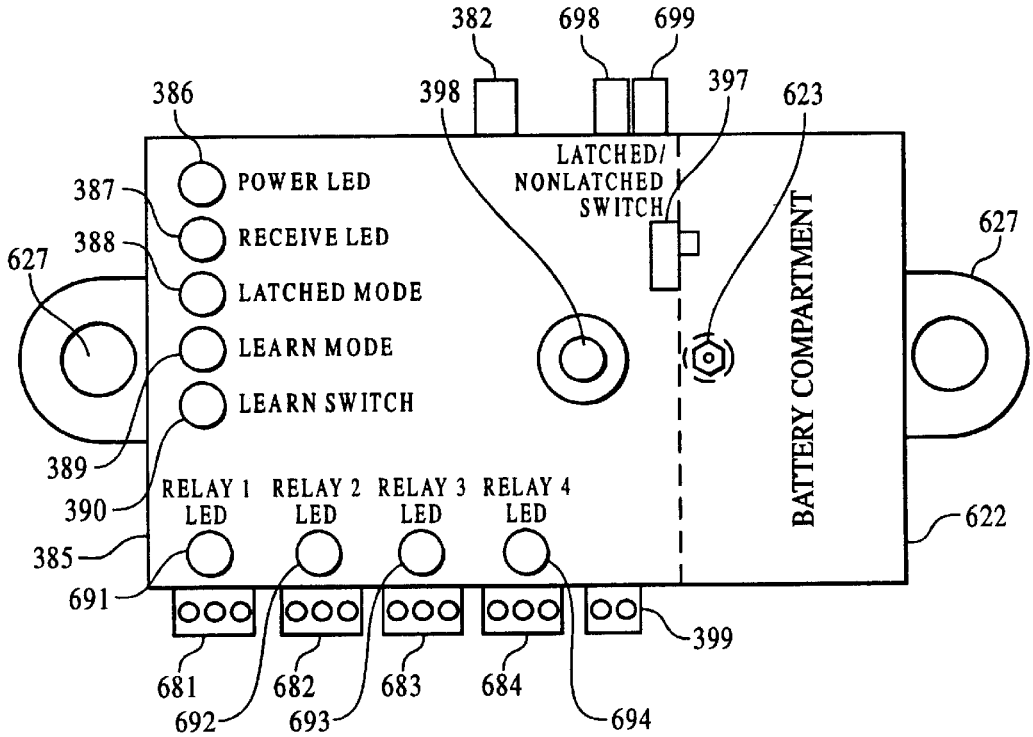
FIGS. 9 to 11 are top and first and second side views, respectively, of the wireless interface receiver of FIG. 8.
Figure 10:
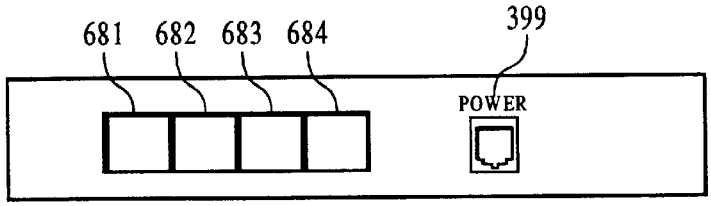
Figure 11:
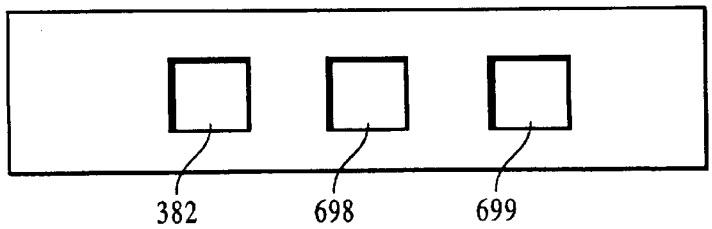

FIGS. 5–7 show a preferred form of transmitter for the security system. The transmitter is addressable so that only specific receivers respond to alarms. The transmitter is preferably provided with backup battery power 311, such as a 9V battery or four AA batteries. If main power goes down, or if interface cable 500 is cut, battery power 311 will be used to transmit an alarm signal to the receiver. The battery power source is housed in battery compartment 322 in housing 315 of the transmitter. Battery compartment 322 can be secured by a tamper proof screw 323 or a tamper switch 324 which is activated when battery compartment 322 is tampered with and which causes the alarm system to generate an alarm signal.

The transmitter preferably includes low battery circuitry 312 which alerts a flash microprocessor 313 in the transmitter if battery power gets weak. Microprocessor 313 in turn will sound a buzzer 314 or other annunciator in the transmitter at regular intervals, preferably every thirty seconds, to indicate a low battery condition.

The housing 315 of the transmitter may be made from a durable extruded material or pre-plated or vinyl coated steel or like material. Preferably housing 315 includes indicators, such as LEDs 316–318 and 328, and a test switch 319. If power is present from the command module or alarm box of the alarm system, power LED 316 will light. If the unit is operating from battery power, power LED 316 will be off. Transmit LED 318 lights each time the transmitter transmits a signal. Preferably, low battery/tamper LED 317 will light for one second every twenty-five seconds for a low battery condition, and for one second every two seconds, if the tamper switch is opened.

Test button or switch 319 may be a jumper that puts the unit into a setup or testing mode. Alternatively, a membrane switch or other suitable switch technology may be used. Pushing switch 319 a first time sends a signal to microprocessor 313 to send a start of alarm signal to the receiver. Five seconds later microprocessor 313 sends a stop alarm signal to the receiver. Holding the test button for ten seconds puts the unit into a continuous test mode. The unit will repeatedly transmit start and stop signals every five seconds and repeat the process every five seconds. When the unit is put into test or setup mode, test LED 328 will light.

Housing 315 also includes an alarm input jack 320 to enable the transmitter to be connected to an alarm box jack on the command module or alarm box of alarm system 200. The alarm module or box provides power, preferably 10 volts dc, ground and the alarm signal to the transmitter unit, preferably via a 6-conductor modular cable with a 6-position, 6-control modular plug at each end.

The transmitter also includes tamper proof interface circuitry 321. If interface cable 500 is cut, circuitry 321 will tell microprocessor 313 to sound buzzer 314 in the transmitter and transmit an alarm signal to the receiver.

The transmitter also includes a radio frequency (RF) module transitter 322, preferably an FM SIL transmitter module that is capable of transmitting up to 250 meters. Transitter 322 preferably has a Cmos/ttl input, no adjustable components, and a very stable operating frequency, with low current consumption and wide operating voltage, preferably 2.7–14 v. The frequency of transitter 322 may be 315, 418, 433 MHz or another frequency depending on the particular needs of the user.

As stated previously, flash microprocessor 313 will sound buzzer 314 and light low battery LED 317 for one second, preferably every twenty-five seconds, if a low battery is sensed. Buzzer 314 will sound continuously if interface cable 500 is cut. Microprocessor 313 preferably has "flash on board" allowing the chip to be reprogrammed both in and out of the circuit. This feature allows the software to be changed or upgraded as new programs are developed. Preferably, microprocessor 313 has a code hopping encoder supporting Keeloq technology or other deciphering algorithm to ensure that each transmission is unique.

Microprocessor 313 senses an alarm condition from the alarm box or module, sounds the buzzer continuously and transmits to the receiver one or more times that the alarm condition has started. Microprocessor 313 also senses when an alarm condition stops, turns the buzzer off and transmits to the receiver one or more times that the alarm condition has stopped.

In addition, microprocessor 313 will sense the cutting of the alarm system interface cable 500. In that case, microprocessor 313 sounds buzzer 314 and transmits to the receiver one or more times that an alarm condition has occurred.

Microprocessor 313 also senses when test button 319 is pushed, turns test LED 328 on, and sends a start alarm signal to the receiver. Five seconds later, microprocessor 313 sends a stop alarm signal to the receiver and turns test LED 328 off. Holding test button 319 for ten seconds puts unit into continuous test mode. Unit will repeatedly transmit start and stop signals every five seconds and repeat process every five seconds. When the unit is put into test or setup mode, test LED 328 will light.

Microprocessor 313 also senses the tampering of battery compartment 322 via tamper switch 324. When tampering is sensed, microprocessor 313 sounds buzzer 314, turns on low battery/tamper LED 317 for one second every two seconds, and transmits an alarm signal to the receiver one or more times.

Microprocessor 313 also lights the transmit LED 318 every time the transmitter transmits to the receiver.

The transmitter also includes a power jack 325 which is used to input power to the transmitter. Preferably, power jack 325 will accept power from the transformer of the alarm system.

An external horn jack 326 is also provided on housing 315 which allows connection of an external horn, light or other annunciator to the transmitter unit. Mounting holes 327 extending from housing 315 may be provided to mount the transmitter to a supporting structure.

FIGS. 8–11 show a preferred form of receiver for the security system. Preferably, the receiver has a receiver circuit with a number of relay alarm outputs, preferably at least 4 to 12. The relays, such as relays 391–394, are preferably disposed in sockets so that the interface cable can be configured to accommodate a particular user's requirements and to replace defective relays easily. Alternatively, any type of switch, dry or wet, analog or digital, may be used in place of the relay. Preferably, twelve alarm outputs are provided, with ten of the alarm outputs being satellite alarm outputs and the remaining two being respectively for the signals indicating disarm of the command module or alarm box and a low battery condition in the alarm system. The receiver is preferably provided with AC power loss circuitry 381 so that if AC power is lost, the unit will go into alarm and trip all relays 391–394.

The receiver also includes a power jack 382 preferably disposed in the side of housing 385 of the receiver. Power jack 382 preferably is a 4 position, 4 contacts modular jack able to accept a 10 vdc transformer such as is present in certain alarm systems.

Housing 385 of the receiver may be made from the same material as is used to make transmitter housing 315. Preferably, housing 385 includes indicators, such as LEDs 386–389, a learn switch 390, and a latched/nonlatched switch 397. If power is present from the 10 vdc power jack 382, the 10–12 DC power terminals 698, or the 24 vac power terminal 699, power LED 386 will light. Receive LED 387 will light every time a transmitter is sensed by the receiver. Latched LED 388 will light if the unit is in latched mode and will be unlit for nonlatched mode. Learn LED 389 is on solid when the receiver is waiting to learn a particular transmitter. Learn LED 389 blinks after the receiver has learned the transmitter.

Each of Relays LEDs 691–694 is associated with a corresponding relay 391–394. Relay LED 691 will go on as long as the first relay is on and will blink if in learn mode and the receiver is waiting to learn the transmitter to trigger the first relay 391. The same is true for Relays LEDs 692–694 for their respective relays 392–394.

Pressing of learn button or switch 390 turns learn LED 389 on solid, along with blinking the first relay LED 691. Once learn LED 389 is on, the unit will poll for a signal for a period of time, for example, thirty seconds. If a transmission received the first time, learn LED 389 will turn off and the first relay 691 will be solid on. If the same transmission is received a second time, learn LED 389 will flash to indicate the transmitter has been learned and the first relay LED 691 will turn off. While the learn LED 389 is on, pressing the learn switch 390 a second time will repeat the process for the second, third and fourth relays 392–394. Holding learn button 390 for a period of time, for example five seconds, while learn LED 389 is on solid will erase all learned transmitters for a particular relay or if no relay LEDs are on, erases all transmitters.

Latched/Nonlatched switch 397 may be a jumper or switch which allows the user to select between latched and nonlatched mode. For latched mode, the relay will remain closed for the duration of the alarm condition. For nonlatched mode, the relay will stay closed only for a selected period of time, preferably the first 250 ms of the alarm condition. Some output devices, such as certain cameras, require a latched mode where a normally open or normally closed dry contact is closed for the entire duration of the alarm. Other devices, including other cameras require a nonlatched mode where a normally open or normally closed dry contact is closed for only 250 ms or other interval so that the camera or other device can continue receive other signals during the alarm condition. The relays may also be designed so that each individual relay has its own jumper or switch so that each relay can be set to the latched or unlatched mode independently of the other relays.

The receiver is preferably provided with backup battery power 383, similar to the transmitter, in case of AC power loss. A tamper proof battery screw 623, like screw 323 in the transmitter, is provided for battery compartment 622 which houses the battery or batteries 383. Mounting holes 627 extending from housing 385 may be provided to mount the receiver to a supporting structure. Circuitry may be included so that an alarm signal is generated in the controller upon tampering with the power sources to the system.

Also like the transmitter, the receiver preferably includes low battery circuitry 384 which alerts a flash microprocessor 395 in the receiver if battery power gets weak. Microprocessor 395 in turn will sound a buzzer 398 or other annunciator in the receiver at regular intervals, preferably every twenty-five seconds, to indicate a low battery condition.

The receiver also includes a radio frequency (RF) module receiver 396, preferably an FM SIL receiver module that has a receiver range of up to 250 meters. RF module receiver 396 preferably has a Cmos/ttl output, no adjustable components, and a very high frequency stability, with low current consumption and a suitable operating voltage, for example 5V. The frequency of RF module receiver 396 may be 315, 418, 433 MHz or another frequency depending on the particular needs of the user.

As stated previously, flash microprocessor 395 will sound buzzer 398, preferably every twenty-five seconds, if a low battery is sensed. Microprocessor 395 preferably has "flash on board" allowing the chips to be reprogrammed both in and out of the circuit to allow for software changes and upgrades. Preferably, microprocessor 395 has a code hopping encoder supporting Keeloq technology or other deciphering algorithm to ensure that the receiver does not mistake stray signals or noise as valid transmissions.

Microprocessor 395 senses an alarm condition sent by the transmitter and closes the appropriate relay. If the receiver is set to the nonlatched condition, the relay is closed for a suitable period of time, preferably 250 ms. If the receiver is set to the latched condition, the relay is closed and remains closed until the system receives a stop signal. Microprocessor 395 also senses the stop of the alarm condition sent by the transmitter and opens the appropriate relay.

Microprocessor 395 also will sense AC power loss and sound buzzer 398 and close relays 391–394 until AC power is restored if latched/nonlatched switch 397 is set to latched mode. Microprocessor 395 will open all relays after a selected interval, such as 250 ms, if latched/nonlatched switch 397 is set to nonlatched mode.

Microprocessor 395 also senses the pressing of learn button 390. When learn button 390 is pressed, microprocessor 395 selects programming of a particular transmitter for a selected relay and stores the unique transmitter information in an eeprom or other non-volatile memory when received. Microprocessor 395 will also sense the holding of learn button 390 and erase any transmitter information stored in memory.

The receiver is also provided with terminals, for example w and/or screwless terminals 681–684 for each of relays 691–694. These terminals provide for easy connection of wires the dry contact of a CCTV camera or other output device. Each of terminals 681–684 include a relay common contact for its associated relay, a normally open contact, and a normally closed contact.

The receiver also includes a 2-conductor cable 701–704 connecting each relay to the respective input 801–804 of its associated CCTV camera or other output device. One wire in the cable will connected to the common contact of the associated relay. The other will either connect to the normally open or normally closed contact of the relay depending on what input the CCTV camera or output device requires.

The receiver also includes three terminals 382, 698, 699 for input power and one terminal for output power 399. All these terminals may be screw, screwless or jack terminals, or other suitable terminals. Preferably, the input power ranges from 9 vdc to 12 vdc. For example, terminal 382 may be for 10 vdc power input, terminal 698 may be for 10–12 dc power input and terminal 699 may be for 24 vac power input. For certain installations, the receiver may be designed to accept higher dc voltages as well as some AC voltages. The output power 399 can supply power for an external device, such as a remote light or buzzer.

Each transmitter and receiver may also be designed as a transceiver to simplify installation of the system. The transceiver at the command module or alarm box of the alarm system preferably provides an indication that the transceiver at the output device is receiving a signal. For example, the transceiver 301 connected to the command module or alarm box 200 would transmit the signal to the transceiver 351 connected to an alarm input of various output devices. Transceiver 351 would then send an acknowledgment back to transceiver 301 which preferably provides an indication, such as by lighting a "Received OK" LED to indicate that the transmission went through.

For portable receivers, such as receiver 358, battery life preferably is approximately three weeks on strictly battery power. A rechargeable battery and charger may also be provided in receiver 358 along with vibrator and/or beeper and clip.

Each transmitter and receiver may also have the option to use rechargeable or nonrechargeable batteries in the unit. For this option, a battery charging circuit and internal jumper would be included in the unit. The user would set the jumper depending on the type of batteries used. Preferably, the unit has a default setting in which the jumper is set for nonrechargeable batteries.

Each output device may be designed to become activated if the wireless interface transmitter is separated from the alarm system or the wireless interface receiver is separated from the output device. For example, an open circuit could be created if the cable connecting the output device to the wireless interface receiver is cut, with the open circuit triggering the output device to turn on. Also, each output device may be designed to become activated when power tampering occurs at the wireless interface transmitter.

While several embodiments of the present invention have been shown and described, it is to be understood that many changes and modifications may be made thereunto without departing from the spirit and scope of the invention as defined in the appended claims.

What is claimed is:

1. A merchandise security system for monitoring objects to be secured against theft, which comprises:

(a) an alarm system comprising a controller for sensing alarm events generated by the alarm system, one or more hubs connected to the controller, and a plurality of sensors capable of attachment to a plurality of objects to be secured, a set of sensors within the plurality of sensors being attached to a corresponding hub, each sensor or hub generating an alarm event when separated from the controller or object to be secured, the controller generating an alarm signal in response to an alarm event generated by said sensor or hub;

(b) an alarm interface coupled to said alarm system, said alarm interface comprising:

at least one wireless interface transmitter for wirelessly transmitting at least one alarm signal; and at least one wireless interface receiver adapted to receive at least one of said at least one alarm signal transmitted from said at least one wireless interface transmitter when said at least one alarm signal contains selected information; and (c) at least one output device connected to at least one of said at least one wireless interface receiver, at least one of said at least one output device being activated by at least one of said at least one wireless interface receiver in response to said at least one alarm signal received by said at least one wireless interface receiver;

wherein:

each of said at least one wireless interface transmitter comprises an addressable flash microprocessor selectively communicating with at least one selected wireless interface receiver of said at least one wireless interface receiver.

2. The merchandise security system according to claim 1 wherein said at least one alarm signal contains information corresponding to a location of the sensor or hub generating an alarm event.

3. The merchandise security system according to claim 1 wherein:

said at least one wireless interface transmitter is connected to said controller by at least one cable communicating said at least one alarm signal;

at least one of said at least one output device is connected to said at least one wireless interface receiver by at least one cable and is activated when power tampering occurs at the wireless interface transmitter, the wireless interface transmitter is separated from the controller, or the wireless interface receiver is separated from the output device.

4. The merchandise security system according to claim 1 wherein an alarm signal is generated by the controller when power tampering occurs at the controller.

5. A merchandise security system for monitoring objects to be scouted against theft, which comprises:

(a) an alarm system comprising a controller for sensing alarm events generated by the alarm system and at least one sensor capable of attachment to the controller and a plurality of objects to be secured, each sensor generating an alarm event when separated from the controller or object to be secured, the controller generating an alarm signal in response to an alarm event generated by said sensor;

(b) an alarm interface coupled to said alarm system, said alarm interface comprising:

at least one wireless interface transmitter for wirelessly transmitting at least one alarm signal; and at least one wireless interface receiver adapted to receive at least one of said at least one alarm signal transmitted from said at least one wireless interface transmitter when said at least one alarm signal contains selected information; and (c) at least one output device connected to at least one of said at least one wireless interface receiver, at least one of said at least one output device being activated by at least one of said at least one wireless interface receiver in response to said at least one alarm signal received by said at least by said at least one wireless interface receiver;

wherein:

each of said at least one wireless interface transmitter comprises an addressable flash microprocessor selectively communicating with at least one selected wireless interface receiver of said at least one wireless interface receiver.

6. The merchandise security system according to claim 5 wherein said at least one alarm signal contains information corresponding to a location of the sensor generating an alarm event.

7. The merchandise security system according to claim 5 wherein:

said at least one wireless interface transmitters are connected to said controller by at least one cable communicating said at least one alarm signal;

at least one of said at least one output device is connected to said at least one wireless interface receiver by at least one cable and is activated when power tampering occurs at the wireless interface transmitter, the wireless interface transmitter is separated from the controller, or the wireless interface receiver is separated from the output device.

8. The merchandise security system according to claim 5 wherein an alarm signal is generated by the controller when power tampering occurs at the controller.

9. An alarm interface system for actuating at least one output device in response to an alarm system coupled to said alarm interface system, which comprises:

(a) at least one wireless interface transmitter for wirelessly transmitting at least one alarm signal; and (b) at least one wireless interface receiver adapted to receive at least one of said at least one alarm signal transmitted from said at least one wireless interface transmitter when said at least one alarm signal contains selected information;

wherein:

each of said at least one wireless interface transmitter comprises an addressable flash microprocessor selectively communicating with at least one selected wireless interface receiver of said at least one wireless interface receiver.

10. The alarm interface system according to claim 9 further comprising at least one cable connected to said at least one wireless interface transmitter for receiving said at least one alarm signal from the alarm system.

11. A merchandise security system for monitoring objects to be secured against theft, which comprises:

(a) an alarm system comprising a controller for sensing alarm events generated by the alarm system, one or more hubs connected to the controller, and a plurality of sensors capable of attachment to a plurality of objects to be secured, a set of sensors within the plurality of sensors being attached to a corresponding hub, each sensor or hub generating an alarm event when separated from the controller or object to be secured, the controller generating an alarm signal in response to an alarm event generated by said sensor or hub;

(b) an alarm interface coupled to said alarm system, said alarm interface comprising:

at least one wireless interface transmitters for wirelessly transmitting at least one alarm signal; and at least one wireless interface receiver adapted to receive at least one of said at least one alarm signal transmitted from said at least one wireless interface transmitter when said at least one alarm signal contains selected information; and (c) at least one output device connected to at least one of said at least one wireless interface receiver, at least one of said at least one output device being activated by at least one of said at least one wireless interface receiver in response to said at least one alarm signal received by said at least one wireless interface receiver;

wherein:

each of said at least one wireless interface transmitter comprises an addressable microprocessor selectively communicating with at least one selected wireless interface receiver of said at least one wireless interface receiver; and at least one of said at least one output device comprising a video recorder connected to said at least one of said at least one interface receiver and activated by said at least one of said at least one interface receiver.

12. A merchandise security system tot monitoring objects to be secured against theft, which comprises:

(a) an alarm system comprising a controller for sensing alarm events generated by the alarm system, one or more hubs connected to the controller, and a plurality of sensors capable of attachment to a plurality of objects to be secured, a set of sensors within the plurality of sensors being attached to a corresponding hub, each sensor or hub generally an alarm event when separated from the controller or object to be secured, the controller generating an alarm signal in response to an alarm event generated by said sensor or hub;

(b) an alarm interface coupled to said alarm system, said alarm interface comprising:

at least one wireless interface transmitter for wirelessly transmitting at least one alarm signal; and at least one wireless interface receiver adapted to receive at least one of said at least one alarm signal transmitted from said at least one wireless interface transmitter when said at least one alarm signal contains selected information; and (c) at least one output device connected to at least one of said at least one wireless interface receiver, at least one of said at least one output device being activated by at least one of said at least one wireless interface receiver in response to said at least one alarm signal received by said at least one wireless interface receiver;

wherein:

each of said at least one alarm signal is communicated by a radio frequency transmission be wean at least one of said at least one wireless interface transmitter and at least one of said at least one wireless interface receiver;

said alarm interface automatically adjusts the frequency of the radio frequency transmission to adapt to environmental noise conditions; and said at least one of said at least one wireless interface receiver activates a relay to activate said at least one of said at least one output device.

13. A merchandise security system for monitoring objects to be secured against theft, which comprises:

(a) an alarm system comprising a controller for sensing alarm events generated by the alarm system, one or more hubs connected to the controller, and a plurality of sensors capable of attachment to a plurality of objects to be secured, a set of sensors within the plurality of sensors being attached to a corresponding hub, each sensor or hub generating an alarm event when separated from the controller or object to be secured, the controller generating an alarm signal in response to an alarm event generated by said sensor or hub;

(b) an alarm interface coupled to said alarm system, said alarm interface comprising:

at least one wireless interface transmitters for wirelessly transmitting at least one alarm signal; and at least one wireless interface receivers adapted to receive at least one of said at least one alarm signal transmitted from said at least one wireless interface transmitter when said at least one alarm signal contains selected information; and (c) at least one output device connected to at least one of said at least one wireless interface receiver, at least one of said at least one output device being activated by at least one of said at least one wireless interface receiver in response to said at least one alarm signal received by said at least one wireless interface receiver;

wherein said at least one wireless interface receiver has a plurality of relays respectively connected to a corresponding one of said at least one output device for activation thereof in an alarm condition, each of said relays being able to be selectively placed in a latched state or a nonlatched state each relay in the latched state remaining in an alarm condition until the controller is reset and each relay in the nonlatched state remaining in an alarm condition for a selected period of time before returning to a nonalarm condition.

14. A merchandise security system for monitoring objects to be secured against theft, which comprises:

(a) an alarm system comprising a controller for sensing alarm events generated by the alarm system, one or more hubs connected to the controller, and a plurality of sensors capable of attachment to a plurality of objects to be secured, a set of sensors within the plurality of sensors being attached to a corresponding hub, each sensor or hub generating an alarm event when separated from the controller or object to be secured, the controller generating an alarm signal in response to an alarm event generated by said sensor or hub;

(b) an alarm interface coupled to said alarm system, said alarm interface comprising:

at least one wireless interface transmitter for wirelessly transmitting at least one alarm signal; and at least one wireless interface receiver adapted to receive at least one of said at least one alarm signal transmitted from said at least one wireless interface transmitter when said at boot one alarm signal contains selected information; and (c) at least one output device connected to at least one of said at least one wireless interface receiver, at least one of said at least one output device being activated by at least one of said at least one wireless interface receiver in response to said at least one alarm signal received by said at least one wireless interface receiver;

wherein said at least one output device comprises a plurality of cameras, each camera directed to monitor a respective area containing objects, within the plurality of objects to be secured and activated by a relay for the camera activated by said at least one wireless interface receiver.

15. A merchandise security system for monitoring objects to be secured against theft, which comprises:

(a) an alarm system comprising a controller for sensing alarm events generated by the alarm system and at least one sensor capable of attachment to the controller and a plurality of objects to be secured, each sensor generating an alarm event when separated from the controller or object to be secured, the controller generating an alarm signal in response to an alarm event generated by said sensor;

(b) an alarm interface coupled to said alarm system, said alarm interface comprising:

at least one wireless interface transmitters for wirelessly transmitting at least one alarm signal; and at least one wireless interface receiver adapted to receive at least one of said at least one alarm signal transmitted from said at least one wireless interface transmitter when said at least one alarm signal contains selected information; and (c) at least one output device connected to at least one of said at least one wireless interface receiver, at least one of said at least one output device being activated by at least one of said at least one wireless interface receiver in response to said at least one alarm signal received by said at least one wireless interface receiver;

wherein:

each of said at least one wireless interface transmitter comprises an addressable microprocessor selectively communicating with at least one selected wireless interface receiver of said at least one wireless interface receiver; and at least one of said at least one output device comprising a video recorder connected to said at least one of said at least one interface receiver and activated by said at least one of said at least one interface receiver.

16. A merchandise security system for monitoring objects to be secured against theft, which comprises:

(a) an alarm system comprising a controller for sensing alarm events generated by the alarm system, and at least one sensor capable of attachment to the controller, and a plurality of objects to be secured, each sensor generating an alarm event when separated from the controller or object to be secured, the controller generating an alarm signal in response to an alarm event generated by said sensor;

(b) an alarm interface coupled to said alarm system, said alarm interface comprising:

at least one wireless interface transmitter for wirelessly transmitting at least one alarm signal; and at least one wireless interface receiver adapted to receive at least one of said at least one alarm signal transmitted from said at least one wireless interface transmitter when said at least one alarm signal contains selected information; and (c) at least one output device connected to at least one of said at least one wireless interface receiver, at least one of said at least one output device being activated by at least one of said at least one wireless interface receiver in response to said at least one alarm signal received by said at least one wireless interface receiver;

wherein:

each of said at least one alarm signal is communicated by a radio frequency transmission be wean at least one of said at least one wireless interface transmitter and at least one of said at least one wireless interface receiver;

said alarm interface automatically adjusts the frequency of the radio frequency transmission to adapt to environmental noise conditions; and said at least one of said at least one wireless interface receiver activates a relay to activate said at least one of said at least one output device.

17. A merchandise security system for monitoring objects to be secured against theft, which comprises:

(a) an alarm system comprising a controller for sensing alarm events generated by the alarm system, and at least one sensor capable of attachment to the controller and a plurality of objects to be secured, each sensors generating an alarm event when separated from the controller or object to be secured, the controller generating an alarm signal in response to an alarm event generated by said sensor;

(b) an alarm interface coupled to said alarm system, said alarm interface comprising:

at least one wireless interface transmitters for wirelessly transmitting at least one alarm signal; and at least one wireless interface receivers adapted to receive at least one of said at least one alarm signal transmitted from said at least one wireless interface transmitter when said at least one alarm signal contains selected information; and (c) at least one output device connected to at least one of said at least one wireless interface receiver, at least one of said at least one output device being activated by at least one of said at least one wireless interface receiver in response to said at least one alarm signal received by said at least one wireless interface receiver;

wherein said at least one wireless interface receiver has a plurality of relays respectively connected to a corresponding one of said at least one output device for activation thereof in an alarm condition, each of said relays being able to be selectively placed in a latched state or a nonlatched state, each relay in the latched state remaining in an alarm condition until the controller is reset and each relay in the nonlatched state remaining in an alarm condition for a selected period of time before returning to a nonalarm condition.

18. A merchandise security system for monitoring objects to be secured against theft, which comprises:

(a) an alarm system comprising a controller for sensing alarm events generated by the alarm system, and at least one sensor capable of attachment to the controller, and a plurality of objects to be secured, each sensor generating an alarm event when separated from the controller or object to be secure, the controller generating an alarm signal in response to an alarm event generated by said sensor;

(b) an alarm interface coupled to said alarm system, said alarm interface comprising:

at least one wireless interface transmitter for wirelessly transmitting at least one alarm signal; and at least one wireless interface receiver adapted to receive at least one of said at least one alarm signal transmitted from said at least one wireless interface transmitter when said at least one alarm signal contains selected information; and (c) at least one output device connected to at least one of said at least one wireless interface receiver, at least one of said at least one output device being activated by at least one of said at least one wireless interface receiver in response to said at least one alarm signal received by said at least one wireless interface receiver;

wherein said at least one output device comprises a plurality of cameras, each camera directed to monitor a respective area containing objects, within the plurality of objects to be secured and activated by a relay for the camera activated by said at least one wireless interface receiver.

19. An alarm interface system for actuating at least one output device in response to an alarm system coupled to said alarm interface system, which comprises:

(a) at least one wireless interface transmitter for wirelessly transmitting at least one alarm signal; and (b) at least one wireless interface receiver adapted to receive at least one of said at least one alarm signal transmitted from said at least one wireless interface transmitter when said at least one alarm signal contains selected information;

wherein:

each of said at least one alarm signal is communicated by a radio frequency transmission between at least one of said at least one wireless interface transmitter and at least one of said at least one wireless interface receiver;

said alarm interface automatically adjusts the frequency of the radio frequency transmission to adapt to environmental noise conditions; and said at least one of said at least one wireless interface receiver activates a relay to activate an output device.

20. An alarm interface system for actuating at least one output device in response to an alarm system coupled to said alarm interface system, which comprises:

(a) at least one wireless interface transmitter for wirelessly transmitting at least one alarm signal; and (b) at least one wireless interface receiver adapted to receive at least one of said at least one alarm signal transmitted from said at least one wireless interface transmitter when said at least one alarm signal contains selected information;

wherein said at least one wireless interface receiver has a plurality of relays respectively connected to a corresponding one of said at least one output device for activation thereof in an alarm condition, each of said relays being able to be selectively placed in a latched state and or a nonlatched state, each relay in the latched state remaining in an alarm condition until reset and each relay in the nonlatched state remaining in an alarm condition for a selected period of time before returning to a nonalarm condition.

21. A merchandise security system for monitoring objects to be secured against theft, which comprises:

(a) an alarm system comprising a controller for sensing alarm events generated by the alarm system and at least one sensor capable of attachment to the controller and a plurality of objects to be secured, each sensor generating an alarm event when separated from the controller or object to be secured, the controller generating an alarm signal in response to an alarm event generated by said sensor;

(b) an alarm interface coupled to said alarm system, said alarm interface comprising:

at least one wireless interface transmitter for wirelessly transmitting at least one alarm signal; and at least one wireless interface receiver adapted to receive at least one of said at least one alarm signal transmitted from said at least one wireless interface transmitter when said at least one alarm signal contains selected information; and (c) at least one output device connected to at least one of said at least one wireless interface receiver, at least one of said at least one output device being activated by at least one of said at least one wireless interface receiver in response to said at least one alarm signal received by said at least one wireless interface receiver;

wherein said at least one wireless interface receiver has a plurality of relays respectively connected to a corresponding one of said at least one output device for activation thereof in an alarm condition, each of said relays being able to be selectively placed in a latched state and or a non-latched state, each relay in the latched state remaining in an alarm condition until the controller is reset and each relay in the non-latched state remaining in an alarm condition for a selected period of time before returning to a non-alarm condition; and wherein the alarm interface system is coupled to an alarm system selected from the group consisting of a fire alarm and a motion detector and actuates at least one output device in response to a signal from said alarm system.

* * * * *

UNITED STATES PATENT AND TRADEMARK OFFICE

CERTIFICATE OF CORRECTION

PATENT NO. : 7,002,467 B2 
APPLICATION NO. : 10/137879
DATED : February 21, 2006
INVENTOR(S) : Deconinck et al.

It is certified that error appears in the above-identified patent and that said Letters Patent is hereby corrected as shown below:

In Column 14, line 1 (line 16 of Claim 11), please change “transmitters” to: --transmitter--.
In Column 14, lines 20-21 (Lines 35-36 of Claim 11), please change “comprising” to: --comprises--.
In Column 14, line 24 (Line 1 of Claim 12), please change “tot” to correctly read: --for--.
In Column 14, line 53 (Line 30 of Claim 12), please change “be wean” to correctly read: --between--.
In Column 15, line 12 (Line 16 of Claim 13), please change “transmitters” to: --transmitter--.
In Column 15, line 14 (Line 18 of Claim 13), please change “receivers” to: --receiver--.
In Column 15, line 30 (Line 34 of Claim 13), after “nonlatched state”, please insert: --,--.
In Column 15, line 55 (Line 21 of Claim 14), please change the word “boot” to correctly read: --least--.
In Column 15, line 65 (Line 3l of Claim 14), after the word “objects” please delete: “,”.
In Column 16, line 13 (Line 13 of Claim 15), please change “transmitters” to: --transmitter--.
In Column 16, lines 32-33 (Lines 32-33 of Claim 15), please change “comprising” to: --comprises--.
In Column 16, line 40 (Line 5 of Claim 16), after the word “controller” delete: “,”.
In Column 16, line 63 (Line 28 of Claim 16), please change “be wean” to correctly read: --between--.
In Column 17, line 19 (Line 13 of Claim 17), please change “transmitters” to: --transmitter--.
In Column 17, line 21 (Line 15 of Claim 17), please change “receivers” to: --receiver--.
In Column 17, line 49 (Line 8 of Claim 18), please change “secure” to: --secured--.
In Column 18, line 3 (Line 28 of Claim 18), after the word “objects” please delete: “,”.
In Column 18, line 43 (Line 16 of Claim 20) after the word “state” (first occurrence), please delete: “and”.

UNITED STATES PATENT AND TRADEMARK OFFICE

CERTIFICATE OF CORRECTION

PATENT NO. : 7,002,467 B2
APPLICATION NO. : 10/137879
DATED : February 21, 2006
INVENTOR(S) : Deconinck et al.

It is certified that error appears in the above-identified patent and that said Letters Patent is hereby corrected as shown below:

In Column 19, line 12 (Line 31 of Claim 21) after the word "state" (first occurrence), please delete: "and".

Signed and Sealed this

Sixth Day of February, 2007

JON W. DUDAS
*Director of the United States Patent and Trademark Office*